US005372515A

United States Patent [19]

Miller et al.

[11] Patent Number: 5,372,515

[45] Date of Patent: Dec. 13, 1994

[54] MECHANICAL ESD PROTECTOR

[75] Inventors: Gary Miller, Vestal; Robert D. LeVasseur, Binghamton, both of N.Y.

[73] Assignee: Martin Marietta Corporation, Philadelphia, Pa.

[21] Appl. No.: 74,401

[22] Filed: Jun. 10, 1993

[51] Int. Cl.[5] ..... H01R 13/52

[52] U.S. Cl. ..... 439/138

[58] Field of Search ..... 439/138

[56] References Cited

U.S. PATENT DOCUMENTS

| | | | |
|---|---|---|---|
| 4,149,027 | 4/1979 | Asher et al. | 174/52 |
| 4,176,897 | 12/1979 | Cameron | 339/40 |
| 4,217,019 | 8/1980 | Cameron | 339/40 |
| 4,345,808 | 8/1982 | Ingham | 339/40 |
| 4,475,784 | 10/1984 | Lukawich | 339/43 |
| 4,514,024 | 8/1985 | Clark | 339/40 |
| 4,531,176 | 7/1985 | Beecher, II | 361/424 |
| 4,791,608 | 12/1988 | Fushimoto | 365/52 |
| 4,847,411 | 7/1989 | Inoue | 439/138 |
| 5,002,495 | 3/1991 | Tanaka | 439/108 |
| 5,167,516 | 12/1992 | Tan et al. | 439/141 |
| 5,211,566 | 5/1993 | Bates et al. | 439/138 |

FOREIGN PATENT DOCUMENTS

| | | | |
|---|---|---|---|
| 232792 | 8/1987 | European Pat. Off. | 439/138 |
| 161683 | 6/1989 | Japan | 439/138 |

*Primary Examiner*—William Briggs

*Attorney, Agent, or Firm*—Geoffrey H. Krauss

[57] ABSTRACT

An ESD protection subassembly for a conductively-case module having an electrical connector mounted thereon, uses a conductive shield shell member formed about the connector and connected to the module conductive case; the shell member has at least one conductive door member mounted thereon by associated hinge formations having spring-like mechanisms for urging the door members to close off an opening in the shell member whenever the module is not mated with an associated receptacle connector. A substantially complete conductive peripheral enclosure is thus formed for the module and its attached connector, whether the module is mounted in a larger assembly with its complementary connector actually mated with the module-mounted connector, or if the module has been removed from the rack assembly.

4 Claims, 4 Drawing Sheets

Fig. 1a
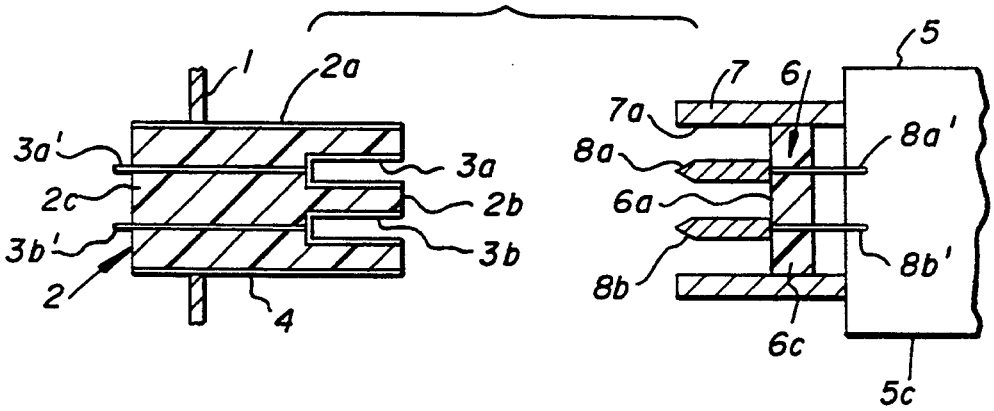
Fig. 1b
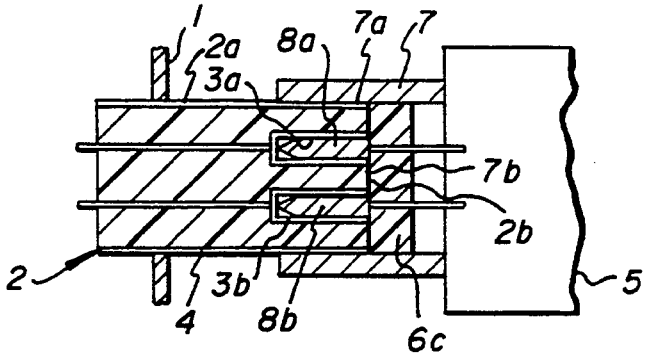
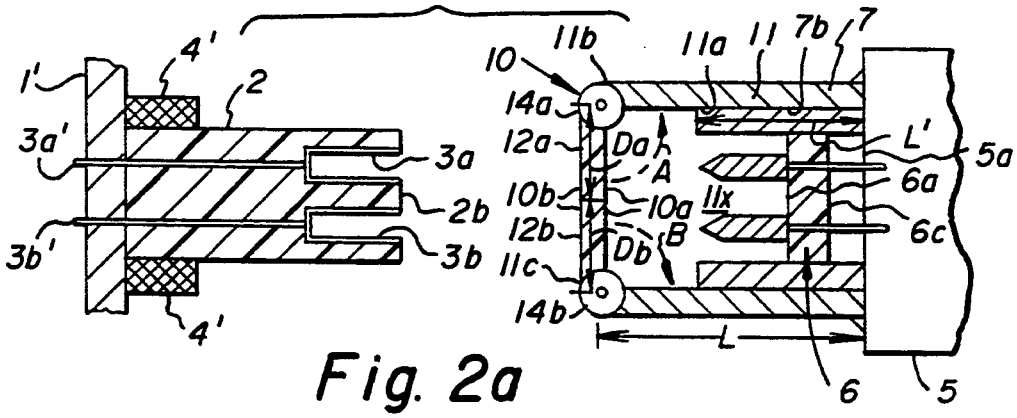
Fig. 2a
Fig. 2b
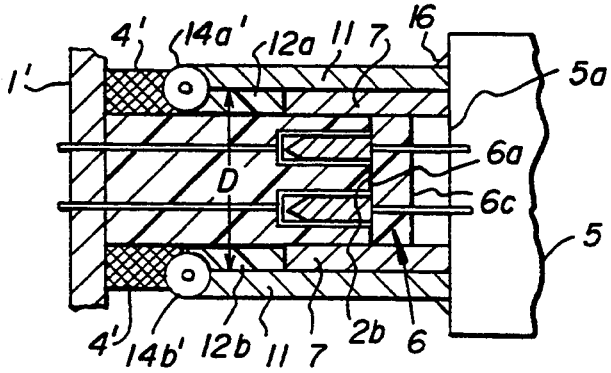

Fig. 2c
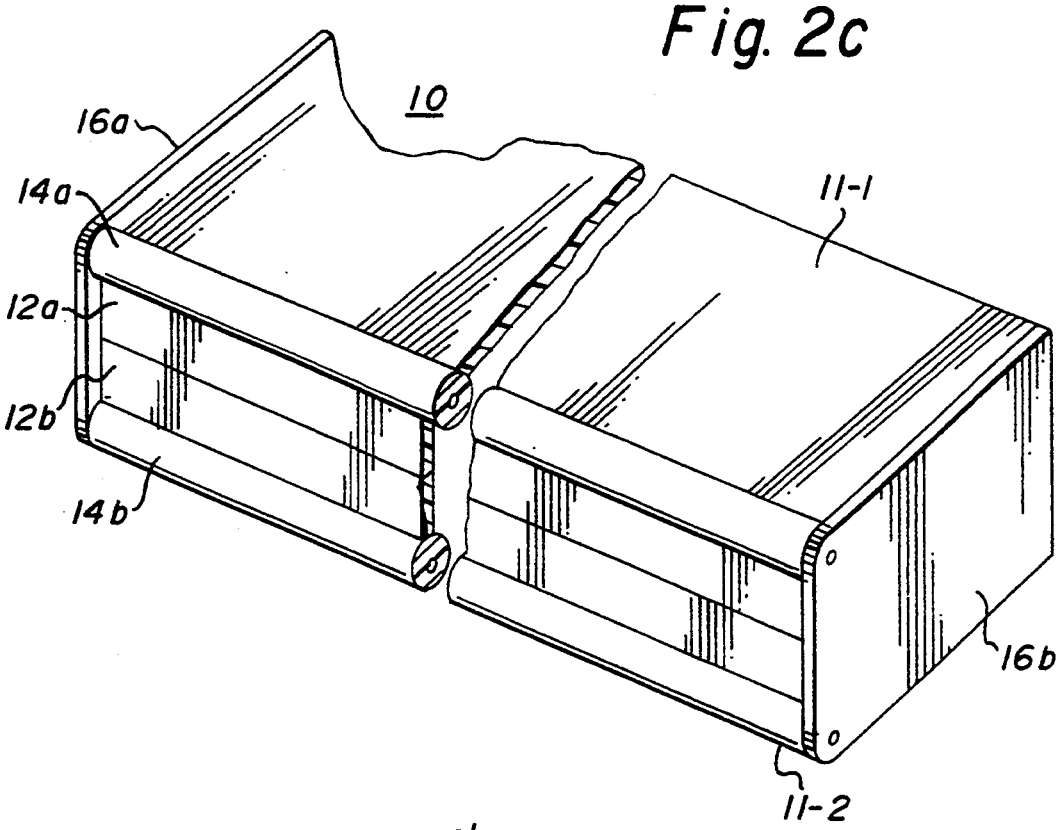
Fig. 3a
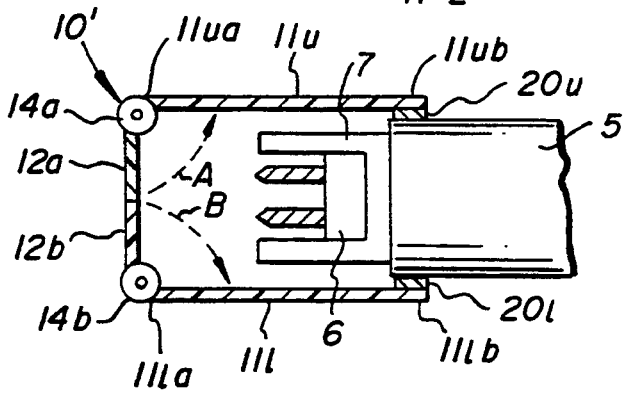
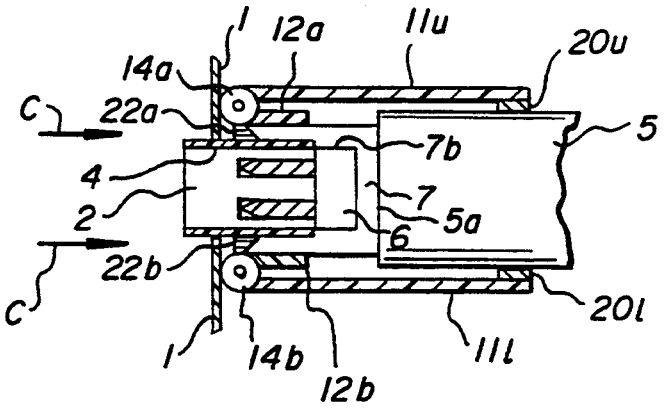
Fig. 3b

MECHANICAL ESD PROTECTOR

BACKGROUND OF THE INVENTION

The present invention relates to electronics module connectors having a novel mechanical electrostatic discharge (ESD) protector.

It is now well known in many forms of electronics equipment to package circuitry in an modular assembly known as a Line Replaceable Module (LRM). It is highly desirable to prevent electrostatic discharge (ESD) damage to electronics equipment in such modules. It is relatively easy to prevent ESD damage when the LRM is installed in equipment racks housing a grounded chassis, as by providing the LRM with a conductive case which is connected to the conductive ground circuitry of the rack in which the case is installed; however, it is much more difficult to protect against ESD damage during "field" handling, when the LRM is "free-floating" and is not connected for normal discharge, i.e. surrounding air and/or package materials prevent conduction through to ground potential. One portion of an LRM particularly susceptible to ESD and the like damage is the multi-contact input/output connector typically found on the rear panel of the module; this connector has conductive pins connected to active circuitry within the module. One solution to damage by high voltages, caused by electrostatic discharge or the like, at these LRM input connector pins has been to protect the internal circuitry attached to the individual pins; the form of protection usually comprises an array of diodes and/or resistors which act by clamping action to limit the high voltage ESD reaching the LRM interior active circuits to a lower, safe volt level. These clamping electronic circuits generally have several disadvantages, which include: some module volume, already generally in short supply, must be utilized for the protective clamping circuitry; if the clamping circuitry requires an active voltage to which the higher voltage must be clamped, then that higher voltage may not be present when the module is removed from the rack and is disconnected from a potential source; self test of the protective circuitry is very difficult to achieve, so that functionality may be problematic at best; and active circuit throughput and other performance characteristics may be degraded by the addition of extraneous elements at the LRM input/output connection pins. It is therefore highly desirable to provide a protective device which can be combined with existing modules and their conductive cases and/or module connector shells, to provide a mechanical protective device which increases ESD protection to the module whenever that module has been removed from the rack or apparatus into which it is to be installed, and whenever the module is in a normally ungrounded condition, as during transit and the like.

BRIEF SUMMARY OF THE INVENTION

In accordance with the invention, any module having a conductive case with a surface upon which an electrical connector is provided, within a conductive shield shell member formed about the connector and connected to the module conductive case, and in which the module-mounted connector is adapted for mating to a complementary connector separate from the module and typically connected to a rack or other mounting means of an apparatus into which the module is to be operatively installed, has additional ESD protection provided by at least one conductive door member conductively connected to the connector shell member and/or the module case and having urging means for positioning the door member across an opening in the connector shell member through which the complementary (rack) connector will move during mating, so that a substantially complete conductive peripheral enclosure is formed for the module and its attached connector, whether the complementary connector has actually mated with the module-mounted connector or the module has been removed from the rack assembly.

In several presently preferred embodiments, the door member may be either a single door panel which may be hinged to that portion of a protection shell member at one side of the module connector, or a pair of complementary door panels which each may be hinged to an opposite side of the protection shell member. Spring-loaded hinges may be utilized to urge the door members into a closed condition, with or without additional conductive fingers being utilized to close any gap between the door members and/or the conductive cover shell member. The door members and associated spring-loaded hinges may be mounted to a conductive shell member, which may be: permanently joined to the module case adjacent to the connector-bearing module surface; mounted in movable relation on the module case, with or without spring-loaded means for returning the cover to a rest position; or is manipulated by a member associated with the mating connector.

Accordingly, it is one object of the present invention to provide a novel mechanical arrangement for electrostatic discharge protection of electronics contained within a conductive module case.

This and other objects of the present invention will become apparent upon reading the following detailed description of the presently preferred embodiments of our invention, when considered in conjunction with the associated drawings.

BRIEF DESCRIPTION OF THE DRAWINGS

FIG. 1*a* is a partially sectional side view of a module having a connector with conductive shell member, and of a complementary receptacle, with which it will mate, mounted to an apparatus rack panel;

FIG. 1*b* is a partially sectional side view of the same module in the mated condition with its matching panel-mounted receptacle;

FIGS. 2*a* and 2*b* are sectional side views of one presently preferred embodiment of the invention mounted upon the module, respectively prior to and after mating with the complementary panel-mounted connector;

FIG. 2*c* is a perspective view of the ESD protective subassembly, and useful in appreciating several aspects of the invention;

FIGS. 3*a* and 3*b* are partially sectional side views of another presently preferred embodiment of the present invention, respectively as mounted to the module and with the protective subassembly and module mated with the mating receptacle;

DETAILED DESCRIPTION OF THE INVENTION

Figure 4A:
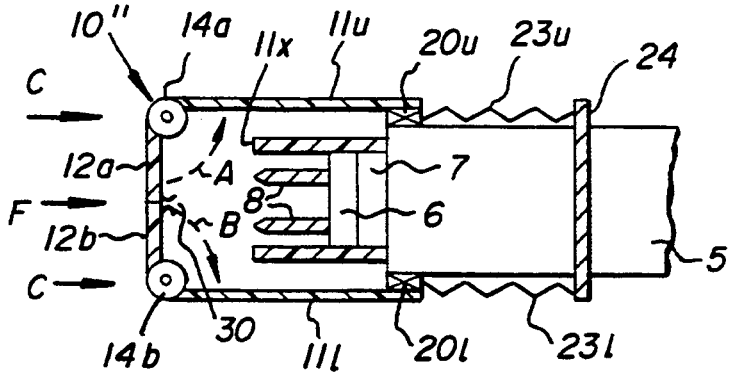
FIGS. 4*a* and 4*b* are partially sectional side views of another presently preferred embodiment having subassembly spring urging means.

Referring initially to FIGS. 1*a* and 1*b*, an instrument or apparatus may have a panel means 1 with a mounting surface, such as a rack panel and the like, to which may be mounted one of several panel connectors 2, each having a plurality of conductive pins 3 for making contact with suitable mating pins in a connector on a separate unit. Typically, a conductive means 4, such as a shell member and the like, is placed about the exterior side periphery 2*a* of the connector, with shell member 4 having means (not shown) for mounting and connecting the conductive shell member to the conductive apparatus panel 1. The connector pins 3, such as upper and lower female receptacle pins 3*a* and 3*b*, are typically connected to lead portions 3*a*′ and 3*b*′ passing through the insulative portion 2*c* of the receptacle connector, for connecting the pins 3 to electronics equipment within the apparatus (i.e. to the left of panel 1). Connector 2 is so configured as to allow a separate, transportable module 5, having a conductive case 5*c* enclosing electronic circuitry to be connected to the apparatus; module 5 is often referred to as a Line Replaceable Module (LRM). Module 5 has a connector 6, having an insulated material portion 6*c*, typically about which a conductive protective shell 7 is provided; if used, shell 7 is connected to the module conductive case 5*c*. A plurality of conductive pins 8*a*/8*b* (such as male pins of dimensions and location design for mating with female receptacles 3) is provided, with each pin 8 connected via its associated lead portion 8*a*′/8*b*′ to the electronics within module 5. ESD protection will be provided even if grounded shells 4 and 7 are not used, as electrostatic charge will be discharged through case 5 when the case is connected to the grounded mounting panel means. When the module is moved into proper position and mounted (as shown in FIG. 1*b*), the interior surface 7*a* of the connector conductive shell 7 butts against, and makes conductive contact with, the receptacle connector shell member 4, so that a ground surface exists between panel 1, shell member 4, shell 7 and module case 5. Conversely, when the module (as shown in FIG. 1*a*) has been withdrawn from the apparatus, connector pins 8 "float" and deleterious and harmful voltages can be provided at lead portions 8*a*′/8*b*′ by electrostatic discharge or other phenomena.

Referring now to FIGS. 2*a*–2*c*, one presently preferred embodiment of our novel ESD-preventing protected subassembly 10 is shown mounted to the connector conductive shell 7 conductively attached to the conductive module case 5*c*. The receptacle 2 can have the conductive shell member 4 (as shown in FIG. 1) or have a conductive compliant member 4′, formed of wire mesh and the like; the receptacle can be mounted to panel 1, as in FIG. 1, or can be mounted in some other manner, such as on a backplane 1′. Thus, the definition of panel means includes backplanes means, and the definition of conductive shell means includes compliant conductive means. Protection subassembly 10 includes a conductive protective shell member 11 having an interior surface 11*a* which is in conductive connection with the conductive exterior surface 7*b* of the connector shell 7. Subassembly shell member 11 may, but need not, abut directly against module conductive case 5*c*. The end 11*b* of shell member 11 furthest from module 5 has an opening 11*c*. The opening 11*c* is closed, when the module 5 is not in the process of being, or actually,-mounted to the apparatus rack 1 and mating connector 2, by a conductive door means 12. As shown, the door means may be a pair of conductive door members 12*a* and 12*b*, respectively having a height $D_a$ and $D_b$, which adds up to a dimension substantially equal to the dimension D of the protective subassembly opening 11*c*. It is not necessary that the sum $D_a+D_b=D$, as each of door members 12*a* and 12*b* is connected to the protective subassembly shell member 11 by means of conductive portions of a separate urging means 14*a* or 14*b*, which typically includes a spring-loaded hinge means, and the like. The length L of protector shell member 11 is longer than the length L′ of the connector shell 7, by at least the depth D′ of each of the door members 12*a* or 12*b* will have when swung, in the direction of associated rotational arrows A or B, about the axis 14*a*′ or 14*b*′ of the associated hinge means 14a or 14*b*. It will be understood that shell member 11 may be a one piece shell or may be a multi-element shell, possibly including separate upper and lower shell portions 11-1 and 11-2 (FIG. 2*c*) integrally connected to conductive sides portions 16*a* and 16*b*.

In operation, when the module 5 is transported or otherwise separated from the panel 1 of the apparatus, the spring-loaded hinges 14 urge the associated door members 12 outwardly, so that the door member interior surfaces 10*a* are substantially adjacent to, or even abutting, one another, so as to provide a conductive surface which closes off the subassembly shell aperture 11*c*. The door members 12 are conductively joined through hinge means 14 to the conductive subassembly shell member 11 and thence to either, or both, of conductive connector shell 7 and module conductive case 5*c*. Shell member 11, in conjunction with hinge means 14 and door members 12 provide a substantially complete conductive enclosure of the front side of the connector volume, which was not previously conductively enclosed by the module case 5*c* and/or conductive connector shell 7. In this embodiment 10′, the protective subassembly conductive shell member 11 is permanently affixed, as by weld 16, to the module case back panel 5*a*. Electrostatic discharge and the like phenomena thus first encounter a conductive surface fully enclosing the enclosed electronics and associated connector pins and thus can not induce potentially harmful voltages therein. When the module 5 is slid, or otherwise moved, into position for mounting (by means not shown) to the apparatus rack panel 1 or backplane 1′, the forward surface 2*b* of the receptacle connector 2 moves into abutment against the protective door member exterior surfaces 10*b*; further movement of module 5 toward panel 1/backplane 1′ requires force to overcome the spring-loaded hinge force and push door members 12*a* and 12*b* respectively in the direction of arrows A and B, so that the door members lie against the shell interior surfaces 11*a* (as shown in FIG. 2*b*); the complementary connective conductor portions 4/4′ and 7 mate and a continuous conductive shield (panel 1 and connector shell 4 to conductive shell 7 and module case 5, or backplane 1′ and compliant conductive member 4′ to shell 7 and case 5) is formed, excluding ESD and other harmful potentials from the interior electronics.

Referring now to FIGS. 3*a* and 3*b*, another presently preferred embodiment of our ESD mechanism 10′ is shown. Here, receptacle 2 has a conductive shell 4 and is mounted on a rack panel 1. An urging means 14 (spring-loaded hinge and the like) may keep conductive door members 12 normally closed to cover protruding connector pins 8; as shown, the conductive materials of the connector sleeve 7, protective subassembly shell member 11 and module case 5c form a substantially continuous and effective Faraday shield over the module 5 and its connector 6. This protector subassembly 10' has an upper conductive member 11u and a lower conductive member 11l, which may be conductively joined to separate end members (such as the members 16a and 16b in FIG. 2c). Upper and lower spring-loaded hinge means 14a and 14b are respectively joined to one end 11ua and 11la of the conductive shell member portions, which have at their opposite ends 11ub and 11lb, upper and lower spring-like contact means 20u and 20l, respectively. Contact means 20 may be spring fingers, conductive mesh and the like, as necessary for providing conductive contact between the shell member portion 11ub/11lb and the module conductive case 5c as the shell member moves in telescoping arrangement over the connector-bearing end of the case 5. Any suitable means 20 which provides a sliding conductive seal may be used. In this configuration, as best shown in FIG. 3b, the mating connector front surface 2b will still urge the door members 12a and 12b to rotate about the hinge means 14a/14b axes, while the module connector 6 and its shell means 7 (whether conductive or not conductive), may need to have forward formations 22a and 22b to assure that the folded door members 12 maintain their positions adjacent subassembly shell interior surface 11a, allowing the connector shell outer surface 7c to pass thereby until the module connector 6 and apparatus connector 2 are fully mated. The fully-mated condition again provides conductive continuity between module case 5c, protective subassembly shell 11, mating connector conductive shield 4 to the apparatus panel 1. It will be seen that it is optional as to whether the entire module connector shell 7 is conductive, or only whether suitable conductive tip portions 22 be utilized between mating conductor conductive shell 4 and the protected subassembly shell 11 portions. It will also be seen that the ESD-protector subassembly 10', due to its movement in the direction of arrows C, by virtue of the engagement of portions 20 against case exterior 5b, may extend for a shorter distance past the plane of contacts 8, with respect to the extension distance of the protected subassembly configuration 10 shown in FIGS. 2a and 2b.

Figure 4B:
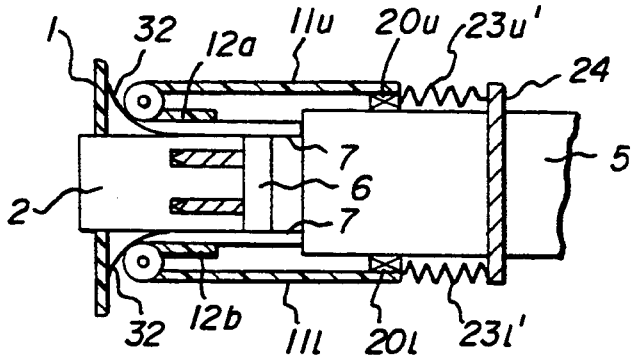

As shown in FIGS. 4a and 4b, another protector subassembly 10" utilizes accordion-like conductive spring members 23, such as an upper member 23u and a lower member 23l, stretching between subassembly wiper portions 20 and a fixed member 24 secured to case 5, for urging the protector subassembly 10" back in the leftward direction (against the force F opening door members 12 and moving shell member 11). It will be seen that, in this configuration (and usable in the other embodiments), actual spring finger-like portions 30 may be affixed to the door members 12 to provide full contact therebetween, if desired. Configuration 10" may require that suitable formations 32 be provided on the mating complementary connector 2, not only to fold doors 12, but also to provide the force necessary to push portion shell 11 rightwardly, so as to fold upper and lower spring portions 23u' and 23l' into their loaded conditions. It will be understood that, as the module is withdrawn rightwardly, the force from formations 32 lessens and the energy stored in loaded spring members 23 force shell member 11 leftwardly, to allow door members 12 to swing about the axis of their associated spring-hinge means 14 and close the "doorway" 11c to the left of pins 8, thereby conductively enclosing the connector pins. Spring members 23 may be of any desired shape, such as leaf springs and the like.

Figure 5A:
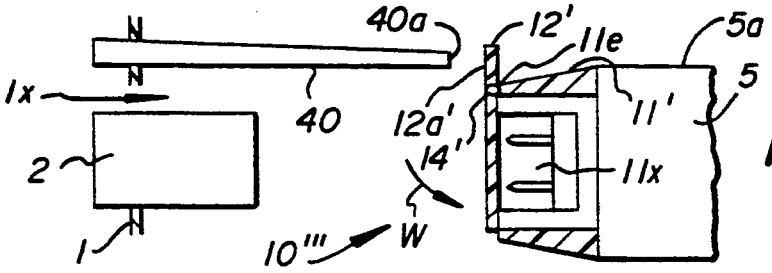
FIGS. 5*a* through 5*c* are partially sectional side views of yet another embodiment, having a single door member and requiring an actuating member associated with the panel-mounted complementary receptacle.
Figure 5B:
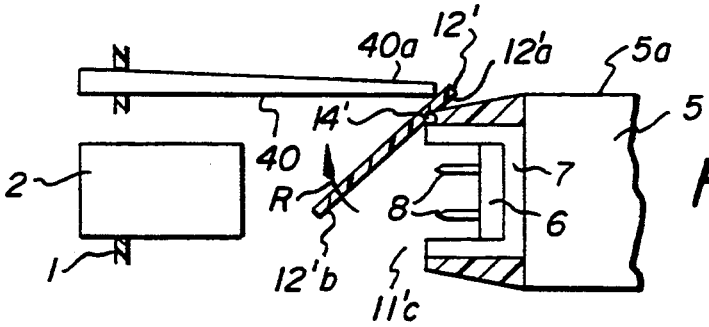
Figure 5C:
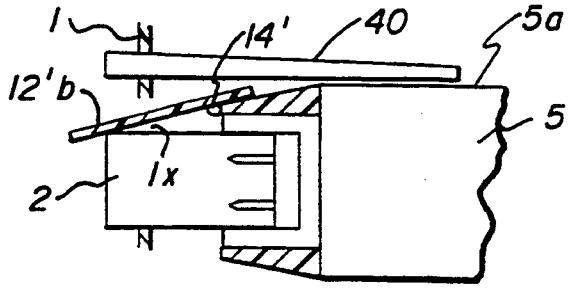

Referring now to FIGS. 5a–5c, a spring-loaded door mechanism 10''' for providing ESD protection to the module-mounted connector 6, without requiring that any large amount of space to the exterior of the LRM be utilized, does not have inwardly-folding door members 12, but rather utilizes one or several outwardly rotating door members 12'; here, a single door member 12' is used. Door member 12' is adapted for opening rotation in the direction of arrow R about a spring-loaded hinge means 14' positioned at one edge (here, the outer upper edge 11e of the protector subassembly conductive shell member 11'); the closure rotation of the hinge means urging mechanism is in the direction of arrow W. In this configuration, with only one outwardly-opening door member 12' and only one hinge means 14', a separate actuator member 40 must be used on the apparatus rack/panel 1 into the vicinity of which the module 5 is moved. Actuator 40 must have a forward portion 40a which abuts an actuator portion 12'a of the door member which is situated above the hinge means 14', with respect to the remainder 12'b of the door member actually closing the opening 11c' and thus the cavity 11'x across the protector subassembly shell member 11'. Thus, when module 5 is removed from the apparatus, for transport and the like purposes, the spring-loaded hinge means 14' moves the conductive door portion 12'b in a counterclockwise rotation, as shown by arrow W, so that the conductive door member conductively contacts shell member 11' and, along with the conductive module case 5a provides a conductive enclosure of the module connector 6. As the module is moved into position for mating with its receptacle 2, mounted on panel 1, the distance between extension end 40a and door member portion 12'a is reduced, until end 40a actually abuts against door member actuator portion 12'a, causing the door member 12' to rotate in the direction of arrow R, away from the module connector cavity 11'x (FIG. 5b). The length of actuator 40 and the length of door member portion 12'b must be coordinated, to assure that door member 12' swings up and out of the way of mating connector 2 prior to interference therebetween. It will be seen, as shown in FIG. 5c, that depending upon the length of mating connector 2, it may be necessary to have a slot or other formation 1x in the panel, into which the door member portion 12'b can move, when fully opened.

Figure 6A:
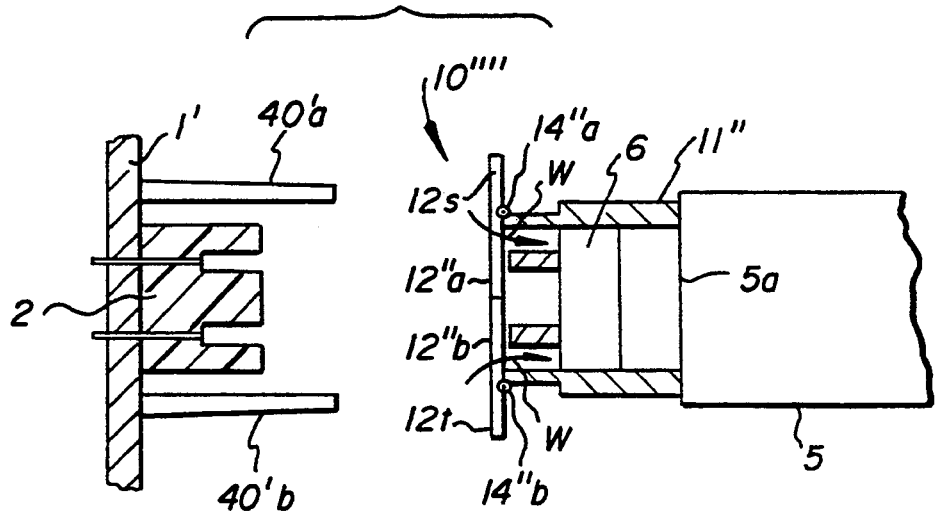
FIGS. 6*a* through 6*c* are partially sectional side views of yet another embodiment, having plural door members and requiring plural actuating members associated with the panel-mounted complementary receptacle.
Figure 6B:
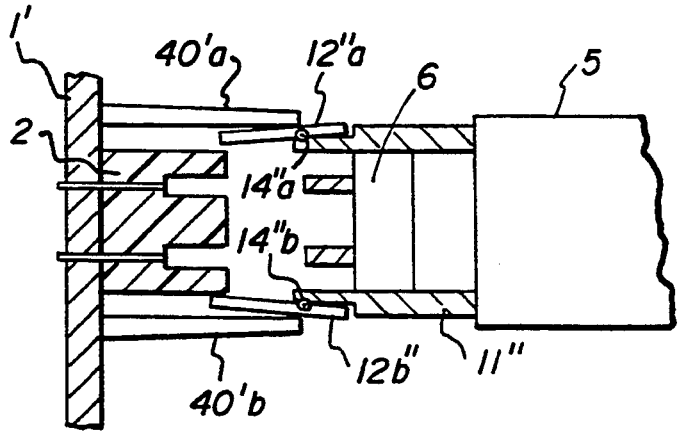
Figure 6C:
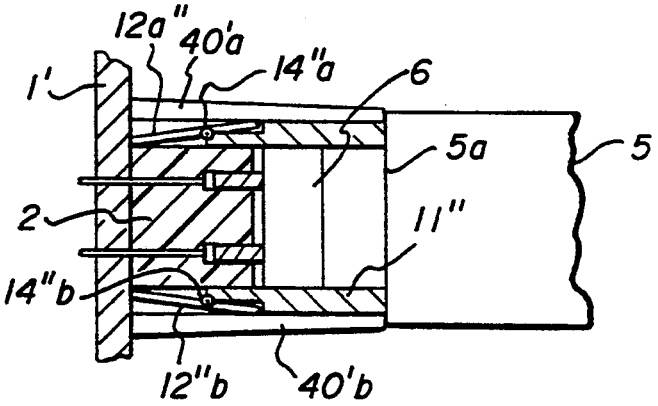

Referring now to FIGS. 6a–6c, another spring-loaded door mechanism 10''' for providing ESD protection to the module-mounted connector 6 first and second outwardly rotating door members 12a" and 12b", respectively. Each door member 12" is adapted for opening rotation in the direction of arrow R about a spring-loaded hinge means 14" positioned at an adjacent edge of the protector subassembly conductive shell member 11'''; the closure rotation of the hinge means urging mechanism is in the direction of arrow W. A like plurality of separate actuator members 40'a/40'b must be used on the apparatus rack/backpanel 1' into the vicinity of which the module 5 is moved. Actuator 40'a is situated above the hinge means 14"a, and actuator 40'b is situated below hinge means 14″*b*. Thus, when module 5 is removed from the apparatus, for transport and the like purposes, the spring-loaded hinge means 14″ rotate both the conductive door portions 12″*a*/12″*b* as shown by arrow W, so that the conductive door member conductively contacts shell member 11″ and, along with the conductive module case 5*a* provides a conductive enclosure of the module connector 6. As the module is moved into position for mating with its receptacle 2, here mounted on backplane 1′, the distance between extension ends 40′*a*/40′*b* and door member portion 12*s*/12*t* is reduced, until ends 40′*a*/40′*b* actually abut against door member actuator portion 12*s*/12*t*, causing the door members to rotate in the direction away from the module connector (FIG. 6*b*) until the connectors 2 and 6 mate (FIG. 6*c*).

While several presently preferred embodiments of our novel mechanical protector subassembly for prevention of ESD and the like deleterious conditions for a module-mounted connector, have been described in detail herein, those skilled in the art will understand that many variations and modifications can now be provided. It is our intent, therefore, to be limited only by the scope of the appending claims, and not by the specific details and instrumentalities presented by way of description of the presently preferred embodiments set forth herein.

What we claim is:

1. A shielding subassembly for use with a transportable electronics-containing module having a conductive case with a surface upon which is mounted an electrical connector means which is to be mated to a complementary connector means mounted on a conductive rack separate from said case, comprising:

a conductive shell member completely surrounding said connector means, and having an opening through which said complementary connector means must pass to make or break connection with said connector means; said shell member being adapted for sliding telescoped movement around a portion of said case, and including means for maintaining conductive contact between the shell member and the case about which the shell member is sliding; and conductive door means for forming a conductive closure completely across said opening and cooperating with said shell member and said case for completing a conductive envelopment of said connector means and the entire attached module, whenever said complementary connector means is not present in said opening.

2. The subassembly of claim 1, wherein the contact means is located on an inner surface of the shell member.

3. The subassembly of claim 1, further comprising: a fixed member affixed to the case; and spring means connected between said shell member and said fixed member for storing energy when said shell member slides in a first direction during engagement of said complementary connector means and for urging the shell member in a second direction, opposite to said first direction, when said complementary connector means is disengaged.

4. The subassembly of claim 3, wherein said spring means includes at least one spring member connected between the shell member and the fixed member.

* * * * *